US005476266A

United States Patent [19]

Caruso

[11] Patent Number: 5,476,266

[45] Date of Patent: Dec. 19, 1995

[54] NET FASTENER DEVICE

[76] Inventor: Vincent C. Caruso, Kwick Goal Ltd., 140 Pacific Dr., Quakertown, Pa. 18951

[21] Appl. No.: 297,377

[22] Filed: Aug. 29, 1994

[51] Int. Cl.[6] ..... A63B 71/02

[52] U.S. Cl. ..... 273/411; 273/127 B; 160/330; 160/345

[58] Field of Search ..... 273/26 A, 181 F, 273/127 B, 394, 404; 160/330, 344, 348

[56] References Cited

U.S. PATENT DOCUMENTS

| | | | |
|---|---|---|---|
| 3,378,879 | 4/1968 | Stall | 160/330 |
| 3,434,524 | 3/1969 | Fein | 160/345 |
| 4,083,395 | 4/1978 | Romano | 160/330 |
| 4,169,598 | 10/1979 | Taylor | 273/127 B |
| 4,368,891 | 1/1983 | Neisius | 273/127 B |
| 4,796,684 | 1/1989 | Saimovitz | 160/330 |
| 5,116,056 | 5/1992 | Schmutte | 273/181 F |

*Primary Examiner*—Theatrice Brown
*Attorney, Agent, or Firm*—Richard L. Miller

[57] ABSTRACT

A net fastener device for affixing a net to a soccer goal frame having two front posts and a crossbar. The device comprises different types of net attaching components for securing the net to the front posts and the crossbar in a safe and quick way. A yoke tool cooperates with the net and fasteners which are to high to reach to permit a person to fasten the net to the goal with out the need of standing on a ladder.

1 Claim, 1 Drawing Sheet

NET FASTENER DEVICE

BACKGROUND OF THE INVENTION

The instant invention relates generally to net supports and more specifically it relates to a net fastener device.

Numerous net supports have been provided in prior art that are adapted to hold nets in their proper position for field games. For example, U.S. Pat. Nos. 4,253,671 to Pace; 4,838,558 to Hauff; 4,948,149 to Lin et al. and 5,156,408 to Hall all are illustrative of such prior art. While these units may be suitable for the particular purpose to which they address, they would not be as suitable for the purposes of the present invention as heretofore described.

SUMMARY OF THE INVENTION

A primary object of the present invention is to provide a net fastener device that will overcome the shortcomings of the prior art devices.

Another object is to provide a net fastener device that will allow a safe and quick way of affixing a net to a soccer goal frame by utilizing different types of net attaching components.

An additional object is to provide a net fastener device which permits a yoke tool to be used to lift up a top edge of the net to engage with hanger connectors in a horizontal channel on the crossbar of the soccer goal frame, so as to eliminate the need for a person from having to stand on a ladder to hook the net on the crossbar.

A further object is to provide a net fastener device that is simple and easy to use.

A still further object is to provide a net fastener device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
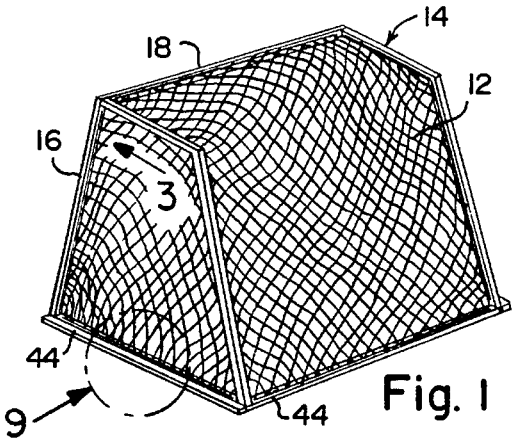
FIG. 1 is a diagrammatic rear perspective view of a typical soccer goal with a net incorporating the instant invention.

Turning now descriptively to the drawings, in which similar reference characters denote similar elements throughout the several views, FIGS. 1 through 10 illustrate a net fastener device for affixing a net 12 to a soccer goal frame 14 having two front posts 16 and a crossbar 18. The device consists of a pair of upright channels 20, each being a single cell having a longitudinal track 21 therein and attached to a rear surface of one front post 16. A plurality of spring clips 22 are provided. Each spring clip 22 has a cylindrical head 24, two legs 26 extend from the head 24. A side foot 28 projects from each leg 26. The head 24 can engage with one side edge 30 of the net 12. The legs 26 can be inserted into one track 21 and rotated ninety degrees, in which the side feet 28 will be retained within the track 21.

A horizontal C-shaped channel 32 is affixed to a rear surface of the crossbar 18. A plurality of hanger connectors 34 are provided. Each hanger connector 34 is similar to clip 22 except that the hanger has a hook portion 36. Two flexible arms 38 extend at a right angle from the hook portion 36. A finger 40 projects away from an outer surface on each arm 38. The arms 38 can be inserted into the C-shaped channel 32 in which said fingers 40 will be retained therein. The hook portion 36 extends upwardly to receive a top edge 42 of the net 12.

The net fastener device further includes three ground base channels 44. Each ground base channel 44 has a plurality of cells with a longitudinal slot 46 therein. The heads 24 of some of the spring clips 22 can be utilized to engage with the bottom edges 48 of the net 12, while the legs 26 with the side feet 28 can be retained within the slots 46 in the ground base channels 44 which are attached to the soccer goal frame 14.

Figure 2:
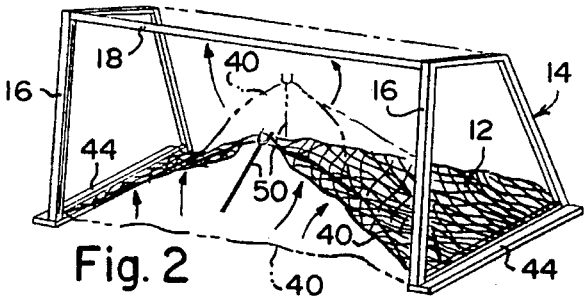
FIG. 2 is a diagrammatic front perspective view illustrating how the net is lifted with a yoke tool to engage the hanger connectors.
Figure 3:
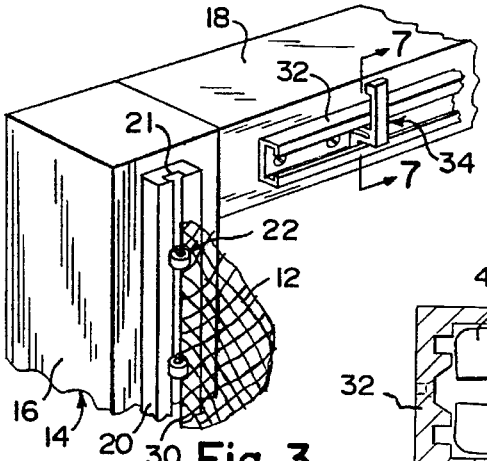
FIG. 3 is an enlarged diagrammatic partial rear perspective view taken in the direction of arrow 3 in FIG. 1 of the soccer goal frame showing various components of the instant invention.
Figure 7:
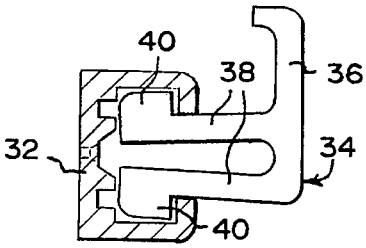
FIG. 7 is an enlarged diagrammatic view partially in cross section with parts broken away taken on line 7—7 of FIG. 3, showing one of the hanger connectors in greater detail engaging the horizontal channel.
Figure 8:
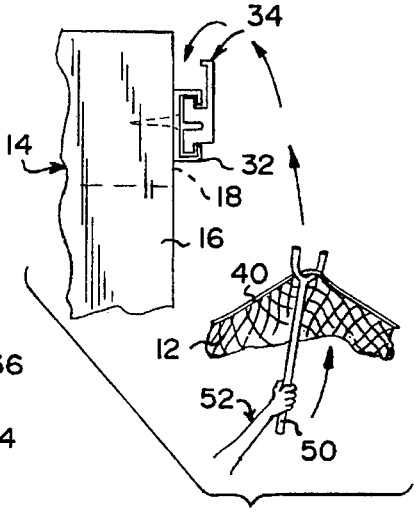
FIG. 8 is a diagrammatic partial side view illustrating how the yoke tool is used to install the upper edge of the soccer net on the hanger connector.
Figure 5:
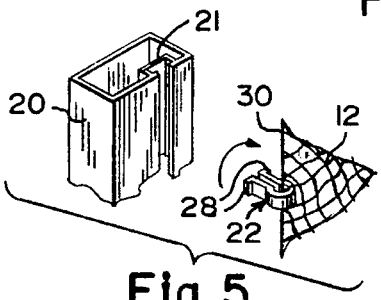
FIG. 5 is an enlarged diagrammatic perspective view illustrating how the clip with the net attached thereto may be inserted into a slot in an upright channel.
Figure 9:
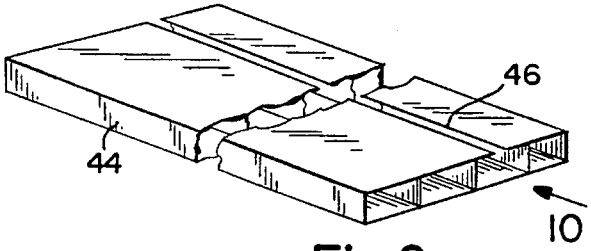
FIG. 9 is an enlarged diagrammatic perspective view as indicated by arrow 9 in FIG. 1, with parts broken away illustrating the ground base channel which has several cells.
Figure 4:
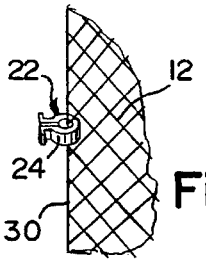
FIG. 4 is an enlarged diagrammatic perspective view illustrating how one of the clips is attached to the net.
Figure 6:
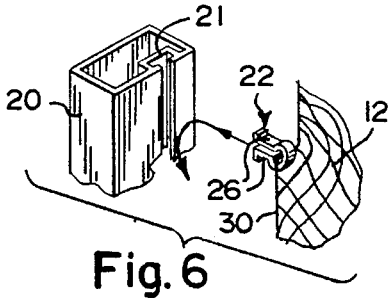
FIG. 6 is an enlarged diagrammatic perspective view showing how the clip must be rotated to permit installation or removal from the slot in the upright channel.
Figure 10:
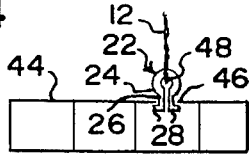
FIG. 10 is a diagrammatic end view taken in the direction of arrow 10 in FIG. 9 illustrating the net with the clip attached thereto.

The net fastener device, as shown in FIGS. 2 and 8, further include a yoke tool 50 to assist a person 52 in lifting the top edge 40 of the net 12 up and over the hook portion 36 on each hanger connector 34.

OPERATION OF THE INVENTION

To use the net fastener device, the person 52 first connects some of the spring clips 22 between the side edges 30 of the net 12 and the upright channels 20. The rest of the spring clips 22 are then connected between the bottom edges 48 of the net 12 and the ground base channels 44. The person 52 can now grip the yoke tool 50 to lift the top edge 40 of the net 12 up and over the hook portions 36 on the hanger connectors 34. This then will complete the safe and quick way of installing the net 12 to the soccer goal frame 12. The net fastener device can also be utilized for other types of game goals such as ice hockey.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A soccer goal comprising a frame having two upright spaced apart front posts and a crossbar having the ends thereof attached respective upper ends of said uprights:

a pair of upright channels, each having a longitudinal track therein and attached to a rear surface of one of said front post;

a plurality of spring clips, each having a cylindrical head, two legs extending from said head and a side foot projecting substantially perpendicular from each said leg, so that said head can engage with one side edge of the net, said legs being manually inserted into a said track and rotated ninety degrees, in which said side feet will be retained within said track and said net to said frame;

a horizontal C-shaped channel affixed to a rear surface of the crossbar;

plurality of hanger connectors, each having a hook portion, two flexible arms extending at a right angle from said hook portion and two fingers, each projecting away from an outer surface on each said arm, so that said arms can be inserted into said C-shaped channel in which said fingers will be retained therein, said hook portion extending upwardly to receive a top edge of the net;

three ground base channels attached to said frame and each having a longitudinal slot therein, said heads of said spring clips being engaged with the bottom edges of the net said side felt of said legs being retained within said slots base channels which are attached to said soccer goal frame; and a yoke tool to assist a person in lifting the top edge of the net up and over said hook portion on each said hanger connector.

* * * * *